US008631871B2

(12) United States Patent
Berruti

(10) Patent No.: US 8,631,871 B2
(45) Date of Patent: Jan. 21, 2014

(54) SYSTEM AND METHOD FOR ENHANCED OIL RECOVERY WITH A ONCE-THROUGH STEAM GENERATOR

(75) Inventor: Alex J. Berruti, Guelph (CA)

(73) Assignee: Innovative Steam Technologies Inc., Cambridge, Ontario (CA)

( * ) Notice: Subject to any disclaimer, the term of this patent is extended or adjusted under 35 U.S.C. 154(b) by 287 days.

(21) Appl. No.: 12/844,186

(22) Filed: Jul. 27, 2010

(65) Prior Publication Data

US 2011/0017449 A1 Jan. 27, 2011

Related U.S. Application Data

(60) Provisional application No. 61/228,809, filed on Jul. 27, 2009.

(51) Int. Cl.
*E21B 43/24* (2006.01)

(52) U.S. Cl.
USPC ..... 166/303; 166/272.1; 166/272.3; 122/406.4

(58) Field of Classification Search
USPC ..... 166/272.1, 272.3, 303; 122/1 B, 406.4, 122/451 S; 165/133, 184
See application file for complete search history.

(56) References Cited

U.S. PATENT DOCUMENTS

| | | | |
|---|---|---|---|
| 3,088,494 | A | 5/1963 | Koch et al. |
| 3,898,428 | A | 8/1975 | Dye |
| 4,044,797 | A | 8/1977 | Fujie et al. |
| 4,118,944 | A | 10/1978 | Lord et al. |
| 4,248,179 | A | 2/1981 | Bonner |
| 4,290,389 | A | 9/1981 | Palchik |
| 4,627,386 | A | 12/1986 | Duffy et al. |
| 4,660,630 | A | 4/1987 | Cunningham et al. |
| 4,661,323 | A | 4/1987 | Olesen |
| 4,705,103 | A | 11/1987 | Zogg et al. |
| 5,237,816 | A | 8/1993 | Duffy et al. |
| 6,302,194 | B1 | 10/2001 | Kastner et al. |
| 6,637,427 | B1 | 10/2003 | Yeomans |
| 2009/0095236 | A1 | 4/2009 | Franke et al. |

*Primary Examiner* — Brad Harcourt
*Assistant Examiner* — Richard Alker

(57) ABSTRACT

A once-through steam generator including one or more steam-generating circuits extending between inlet and outlet ends thereof and including one or more pipes, the steam-generating circuit having a heating segment at least partially defining a heating portion of the once-through steam generator, and one or more heat sources for generating heat to which the heating segment is subjected. The steam-generating circuit is adapted to receive feedwater at the inlet end, the feedwater being subjected to the heat from the heat source to convert the feedwater into steam and water. The pipe has a bore therein at least partially defined by an inner surface, and at least a portion of the inner surface has ribs at least partially defining a helical flow passage. The helical flow passage guides the water therealong for imparting a swirling motion thereto, to control concentrations of the impurities in the water.

7 Claims, 7 Drawing Sheets

SYSTEM AND METHOD FOR ENHANCED OIL RECOVERY WITH A ONCE-THROUGH STEAM GENERATOR

This application claims the benefit of U.S. Provisional Patent Application No. 61/228,809, filed Jul. 27, 2009, and incorporates such provisional application in its entirety by reference.

FIELD OF THE INVENTION

The present invention is a system and a method for extracting crude oil from oil-bearing ground.

BACKGROUND OF THE INVENTION

Once-through steam generators of the prior art which are used in enhanced oil recovery may include one or more steam-generating circuits at least partially defining a radiant chamber into which heat energy is directed, as is well known in the art. The prior art once-through steam generator may be used for enhanced oil recovery, for example, in a steam-assisted gravity drainage ("SAGD") application. (Those skilled in the art would be aware of other enhanced oil recovery methods involving the use of steam.) In a SAGD application, as is well known in the art, steam produced by the prior art once-through steam generator is directed into oil-bearing ground to enhance recovery of oil therefrom.

As illustrated in FIG. 1, a once-through steam generator ("OTSG") 10 of the prior art is included in a system 12 for use in a SAGD application. Feedwater is directed into a steam-generating circuit 14 at an inlet end 16 thereof, as indicated by arrow "A". A part of the steam-generating circuit 14 is located in a convective module 18. As can be seen in FIG. 1, the steam-generating circuit 14 includes a portion thereof which defines a radiant chamber 19, in which one or more pipes 20 of the steam-generating circuit 14 are exposed to radiant heat from a heat source 22, for generating steam. The system 12 includes a first pipe 24 which is connected to the steam-generating circuit 14 at an outlet end 26 thereof. The steam exits the steam-generating circuit 14 at the outlet end 26 thereof and is directed down the first pipe 24 in the direction indicated by arrow "B".

Those skilled in the art will appreciate that the OTSG 10 may utilize a variety of sources of heat. For example, the heat utilized may be waste heat from a gas turbine. In that situation, the OTSG 10 includes the convective module 18, but does not include a radiant chamber. It will be understood that the relevant issues arising in the prior art in connection with generating steam by utilizing a radiant chamber also arise in other configurations, regardless of the source of heat. For the purposes hereof, a "heating portion" of the OTSG may refer to a radiant chamber and/or a convective module, as the case may be.

As is well known in the art, in some applications, the wet steam which is produced is sent to a steam separator (not shown in FIG. 1) to remove the water content, and the resulting dry steam is then sent down the well.

As is also well known in the art, the various enhanced oil recovery processes using steam involve directing the steam through pipes positioned in the ground. The in-ground pipes may be positioned in various ways, depending on the process and/or on the characteristics and location of the oil-bearing ground. It will be appreciated by those skilled in the art that many different arrangements of in-ground pipes may be used. For instance, the arrangement shown in FIG. 1 is only one of a variety of possible arrangements of in-ground pipes.

In the arrangement illustrated in FIG. 1, the steam is released from a substantially horizontal part 28 of the first pipe 24, via holes therein (not shown) positioned and sized to achieve a substantially consistent release of steam into oil-bearing ground 30, as indicated by arrows identified as "C" in FIG. 1. The system 12 also includes a second pipe 32 with a substantially horizontal part 34, which also has holes (not shown) in it.

As is well known in the art, the steam which is released into the ground via the holes in the horizontal part 28 of the first pipe 24 heats crude oil in the oil-bearing ground 30, and also condenses, resulting in a mixture of crude oil and water which is collected in the substantially horizontal part 34 (as identified by arrows identified as "D"), entering the horizontal part 34 via the holes therein. The oil and water mixture is pumped in the direction indicated by arrow "E" to a tank and other facilities 36 on the surface for processing, i.e., separation of the crude oil and the water. As will be described, the separation of the oil and the water is incomplete, and in addition, many impurities other than oil typically are accumulated in the water.

As indicated above, SAGD is only one example of an enhanced oil recovery process involving steam. Many other such processes are known. From the foregoing, however, it will be appreciated that steam quality is an important parameter in connection with the profitability of a particular enhanced oil recovery system which includes a once-through steam generator. In the prior art, due to limitations in achieving high steam quality (i.e., greater than 80%), higher steam quantity is required to achieve greater oil flow and revenue which means correspondingly higher energy inputs resulting in lower overall revenue.

As is well known in the art, any impurities in the feedwater to the once-through steam generators exit the steam-generating circuit with the wet steam generated therein, unless the steam generator "runs dry", in which case, an inner wall surface of the pipe loses water contact and becomes dry. Upon such complete vaporization occurring, the impurities precipitate out onto the inner wall surface, forming a deposit which can significantly adversely affect the performance of the steam-generating circuit. The lack of water is said to constitute a "boiling crisis", as is well known in the art. As the steam quality increases in the circuit (i.e., toward the output end), the remaining water film thickness around the inner surface of the pipe decreases, and the potential for dryout increases.

A cross-section of a portion of the typical horizontal pipe 20 in a prior art steam-generating circuit 14 is shown in FIG. 2A, and a longitudinal cross-section (taken along line A-A in FIG. 2A) is shown in FIG. 2B. The pipe 20 includes an inner bore 38 defined by an inner surface 40. As can be seen in FIGS. 2A and 2B, a mixture of steam ("S") and water ("W") moves through the pipe 20 in the direction indicated by arrow "F" in FIG. 2B. The water W flows in the direction indicated by arrow "F" (i.e., toward the outlet end 26) in an annular film against the inner surface 40, and around the steam S in the center of the bore 38, which is also flowing toward the outlet end. In the prior art pipes, droplets 42 of water tend to become separated from the annular water film W and entrained in the flowing steam S, as is well known in the art.

The feedwater is gradually vaporized, as it moves from the inlet end 16 to the outlet end 26 (FIG. 1). As vaporization progresses, the volume of water decreases, and the concentration of impurities increases accordingly in the remaining water content of the wet steam. Ultimately, if the concentration of impurities becomes sufficiently high, impurities precipitate out to form deposits (not shown) on the inner surface 40 (FIGS. 2A, 2B). The deposits form a thermal barrier on the inner surface 40 and increase the pipe wall temperature, ultimately leading to lower piping material strength. In addition, the deposits can reduce the heat transfer and overall amount of produced wet steam flow.

In FIGS. 1, 2A and 2B, the radiant chamber is horizontal. In this situation, the annular film thickness varies around the inner surface 40 due to gravity effects (FIGS. 2A, 2B). When dryout occurs, it typically occurs at the upper part of the inner wall surface 40 because the water layer is thinner at that point. However, as is well known in the art, the radiant chamber may be positioned vertically, rather than horizontally, and a boiling crisis (pipe surface dry out condition) can also occur in a vertical pipe. The radiant chamber 19 is shown positioned horizontally in FIG. 1 for exemplary purposes only. As is well known in the art, the convective module 18 also may be positioned horizontally or vertically, i.e., oriented for flow of gases therethrough horizontally or vertically. The convective module 18 is shown positioned vertically in FIG. 1 for exemplary purposes only.

In the foregoing discussion, the use of wet steam in the SAGD process is outlined. However, it is also common for the water content of the wet steam to be removed at the outlet end of the steam-generating circuit, so that only dry steam is sent down the well. In this situation as well, higher steam qualities are important, because higher steam qualities result in a lower quantity of high-temperature water that is required to be processed (i.e., removed) within the steam plant, i.e., overall plant economics are improved with smaller recycled water inventories.

From the foregoing, it can be seen that it is important to avoid accumulation of deposits (i.e., due to dry out and known as boiling crises). In horizontal pipe orientations, (e.g., the pipe 20 in FIG. 1), because the annular film thickness decreases as steam quality increases, the film thickness at the upper inner surface may become insufficient to maintain wetness, and dry-out of the upper part of the inner surface is therefore a concern. Accordingly, the known once-through steam generator typically is operated so as to avoid a boiling crisis in its steam-generating circuit(s), i.e., the operating parameters are controlled so as to minimize the risk of a boiling crisis occurring. However, although a boiling crisis can be avoided using this approach, this approach results in generally lower steam quality. For instance, steam quality ratings typically are approximately 80% or less. Such relatively low steam quality means, in effect, that energy inputs into known once-through steam generators are relatively inefficiently utilized.

As is well known in the art, in most applications, steps are taken to substantially purify the feedwater (referred to as "conditioning") before it is pumped into the circuit at the inlet end thereof, so as to minimize the concentration of impurities that have to be dealt with as the water moves through the circuit. However, in the SAGD application for enhanced oil recovery, the extent of conditioning typically is very limited, in order to limit costs. Therefore, in this type of SAGD application, the feedwater typically has relatively high impurities content, i.e., a content that would be unacceptable for most steam generators operating at 100% saturated or superheated outlet steam.

For example, a typical water quality into an enhanced oil recovery OTSG has 8,000 to 12,000 ppm of total dissolved solids (TDS), trace amounts of free oil (1 ppm), high silica levels (50 ppm), dissolved organics (300 ppm), and elevated hardness (1 ppm). The conductivity of this water is in the range of 10,000 micro siemens/cm and compares to less than 1 micro siemens/cm for a typical OTSG producing 100% saturated or superheated steam. The enhanced oil recovery OTSG is operated with wet steam such that the high levels of impurity are concentrated in the water content of the wet steam and carried through the OTSG.

The preferred flow regime in the piping of the heating region 19 is the annular flow regime described above, because wetted wall conditions ensure that dry out does not occur. In this flow regime, a layer of water (wetness) is positioned on the inner surface 40, and also water droplets are entrained within the steam flowing through a central part of the bore of the pipe.

The entrained droplets are separated from the annular film of water W at a point upstream, identified in FIG. 2B as "$U_1$". As is well known in the art, the concentration of impurities in the annular film of water W increases as the water W approaches the outlet end 26, due to the generation of steam from the feedwater, as the feedwater is moved from the inlet end 16 to the outlet end 26. The impurities in the water are concentrated as the steam is produced.

It will be appreciated by those skilled in the art that, when the droplet becomes separated from the water film, the droplet has the same concentration of impurities as does the annular film of water W at $U_1$. It will also be appreciated that, as the steam (including the entrained droplets) and the annular water film travel along the pipe, a difference develops between the concentrations in impurities in the water film and in the entrained droplets. This is a result of the variation of evaporation rates between the annular film and the entrained droplets.

Heat from the heat source is transmitted to the pipe, and then through the pipe wall, and (largely via conduction) to the annular water film. In contrast, heat transmitted to the entrained droplets is also transmitted through the annular water film and through the steam. It is understood that the annular water film typically has a much higher rate of vaporization than the entrained droplets because the heat flux to the entrained droplets is much less.

The net effect of the entrained water droplets is to reduce the film thickness, resulting in an increase in the concentrations of impurities in the annular water film, i.e., adjacent to the inner surface 40. In turn, this increases the tendency to reach oversaturation levels, and to form deposits on the inner surface 40. The foregoing is typical of the prior art enhanced oil recovery once-through steam generation systems.

As can be seen in FIG. 2A, where the pipe 20 is horizontal, the annular water film W tends to collect at the bottom side of the pipe 20, to define a film thickness $T_1$, that is substantially thicker than a film thickness $T_2$ of the water film W at the top of the pipe cross-section. This is a result of gravity acting on the annular water film.

In the prior art, and as shown in FIGS. 3A and 3B, the radiant pipes 20 are exposed to non-uniform heat flux around the pipe perimeter 44. In FIG. 3A, the pipes (identified for convenience as 20A, 20B, and 20C) are positioned proximal to a housing 45. (It will be understood that, for clarity of illustration, the annular water films W and the entrained water droplets 42 are deliberately omitted from FIG. 3A.) Inner sides 46 of the outer pipe perimeters 44 are directly subjected to heat energy from the heat source (represented by the arrows "G"), while outer sides 48 of the perimeters 44 are only indirectly subjected to heat from the heat source 22.

The heat to which the outer sides 48 are subjected is heat energy from the heat source 22 which is redirected (i.e., reflected) by the housing 45. The redirected heat energy is schematically represented by arrows "H" in FIG. 3A. It will be understood that the heat flux represented by arrows "G" is substantially greater than the heat flux represented by arrows "H". As can be seen in FIG. 3B, the heat flux to which the steam and water in the pipe 20 are subjected is unevenly distributed. As a result, the annular film of water W is subjected to different rates of evaporation around the perimeter, resulting in a non-uniform concentration of impurities in the remaining water W. This can lead to impurity oversaturation in some regions, resulting in impurities being deposited.

In the horizontal pipe, the non-uniform film thickness (described above) also results in a concentrating of impurities in the thinner part of the film because the thinner film has less diluting effect, compared to the thicker part of the film at the bottom of the pipe.

Those skilled in the art will appreciate that the parts of the steam-generating circuit illustrated in FIGS. 3A and 3B are positioned at the top of the horizontally-positioned heating region. In other pipes in the steam-generating circuit, located elsewhere relative to the heating portion 19, the uneven distribution of heat has different effects on the water film. For example, in a substantially horizontal heating region with a generally circular portion at least partially defined by the steam-generating circuit, some of the pipes are positioned at the bottom, some are at the sides, and some are located between, relative to the heating region. In such a pipe at the bottom of the heating region, for instance, the top of the pipe will be subjected to the greatest heat flux. As noted above, the thinner part of the annular film is at the top of the pipe, so the uneven distribution of heat flux in this situation exacerbates the issues of dry out and/or concentrations of impurities at the inner surface 40 of the pipe 20. It will be apparent to those skilled in the art that the foregoing applies to any heating region in a prior art OTSG, i.e., whether a radiant chamber or a convective module only.

SUMMARY OF THE INVENTION

For the foregoing reasons, there is a need for an improved once-through steam generator adapted for providing improved steam quality.

In general, the invention provides a system including a OTSG for enhanced oil recovery in which the OTSG is adapted to operate at a much higher exit steam quality, compared to the OTSGs of the prior art operating with high impurity water. The invention eliminates the potential for boiling crises as a result of thinning of a part of the annular water thickness and also substantially eliminates impurity concentration differences within the pipes that can lead to impurity oversaturation and the formation of deposits.

In its broad aspect, the invention provides system for extracting crude oil from oil-bearing ground comprising a system for extracting crude oil from oil-bearing ground including one or more once-through steam generators. Each once-through steam generator includes one or more steam-generating circuits extending between inlet and outlet ends thereof and having one or more pipes. Each steam-generating circuit has a heating segment at least partially defining a heating portion of the once-through steam generator. The system also includes one or more heat sources for generating heat to which the heating segment is subjected. Each steam-generating circuit is adapted to receive feedwater at the inlet end, the feedwater being moved toward the outlet end and being subjected to the heat from said at least one heat source to convert the feedwater into steam and water, the water including concentrations of the impurities, which increase as the water approaches the outlet end. Each pipe includes a bore therein at least partially defined by an inner surface, at least a portion the inner surface having ribs (or rifles) at least partially defining a helical flow passage along the inner surface. The helical flow passage guides the water therealong for imparting a swirling motion thereto, to control concentrations of the impurities in the water. In addition, the system includes a water treatment means for producing the feedwater, and a first ground pipe subassembly in fluid communication with the steam-generating circuit via the outlet end thereof. The first ground pipe subassembly includes a distribution portion for distributing the steam in the oil-bearing ground and a first connection portion, for connecting the distribution portion and the steam-generating circuit. The system also includes a second ground pipe subassembly having a collection portion for collection of an oil-water mixture including the crude oil from the oil-bearing ground and condensed water resulting from condensation of the steam in the ground, The collection portion is in fluid communication with the water treatment means, so that the oil-water mixture is supplied to the water treatment means from the second ground pipe subassembly, and the water treatment means is adapted to produce the feedwater from the oil-water mixture.

In another of its aspects, the invention provides a once-through steam generator including one or more steam-generating circuits extending between inlet and outlet ends thereof and having one or more pipes. Each steam-generating circuit includes a heating segment at least partially defining a heating portion of the once-through steam generator. The once-through steam generator also includes one or more heat sources for generating heat to which the heating segment is subjected. Each steam-generating circuit is adapted to receive feedwater at the inlet end, the feedwater being moved toward the outlet end and being subjected to the heat from the heat source to convert the feedwater into steam and water, and the water having concentrations of the impurities which increase as the water approaches the outlet end. Each pipe includes a bore therein at least partially defined by an inner surface, at least a portion of the inner surface having ribs at least partially defining a helical flow passage along the inner surface. The helical flow passage guides the water therealong for imparting a swirling motion thereto, to control concentrations of the impurities in the water.

In another aspect, the invention provides a method of extracting crude oil from oil-bearing ground including, first, providing a once-through steam generator. Feedwater is supplied to the steam-generating circuit at the inlet end. The feedwater is moved toward the outlet end and subjected to heat from the heat source as the feedwater passes through the pipe to convert the feedwater into steam and water. A water treatment means is provided. Next, the water is directed along the helical flow passage to impart a swirling motion thereto, for controlling concentrations of the impurities in the water. A first ground pipe subassembly in fluid communication with the steam-generating circuit via the outlet end thereof is provided. Also, a second ground pipe subassembly is provided, for collecting the oil-water mixture and supplying it to the water treatment means. The steam is supplied to the first ground pipe subassembly, through which the steam is distributed in the oil-bearing ground. The oil-water mixture is then collected in the second ground pipe subassembly. Finally, the oil-water mixture is supplied to the water treatment means for processing thereby to separate the crude oil and the condensed water. The water produced by the water treatment means may be used as feedwater.

In yet another of its aspects, the invention provides a system for extracting crude oil from oil-bearing ground. The system includes water treatment means is for treating the oil-water mixture, to produce crude oil and water from the oil-water mixture. The collection portion is in fluid communication with the water treatment means, so that the oil-water mixture is supplied to the water treatment means from the second ground pipe subassembly. The feedwater is at least partially provided from a source other than the water treatment means.

In another of its aspects, the invention provides a method of extracting crude oil from oil-bearing ground including providing a once-through steam generator. Feedwater is supplied to the steam-generating circuit at the inlet end. The feedwater is subjected to heat from said at least one heat source as the feedwater passes through the pipe to convert the feedwater into steam and water. The water is directed along the helical flow passage to impart a swirling motion thereto, for controlling concentrations of the impurities in the water. A first ground pipe subassembly is provided in fluid communication with the steam-generating circuit via the outlet end thereof. Also, a second ground pipe subassembly and a water treatment means in fluid communication with the second ground pipe subassembly are provided. The water treatment means is adapted for separating the crude oil and the water in the oil-water mixture, and for treating the water. The oil-water mixture is collected in the second ground pipe subassembly. The oil-water mixture is supplied to the water treatment means for processing thereby, to separate the crude oil and the condensed water.

BRIEF DESCRIPTION OF THE DRAWINGS

The invention will be better understood with reference to the drawings, in which.

DETAILED DESCRIPTION

Figure 1:
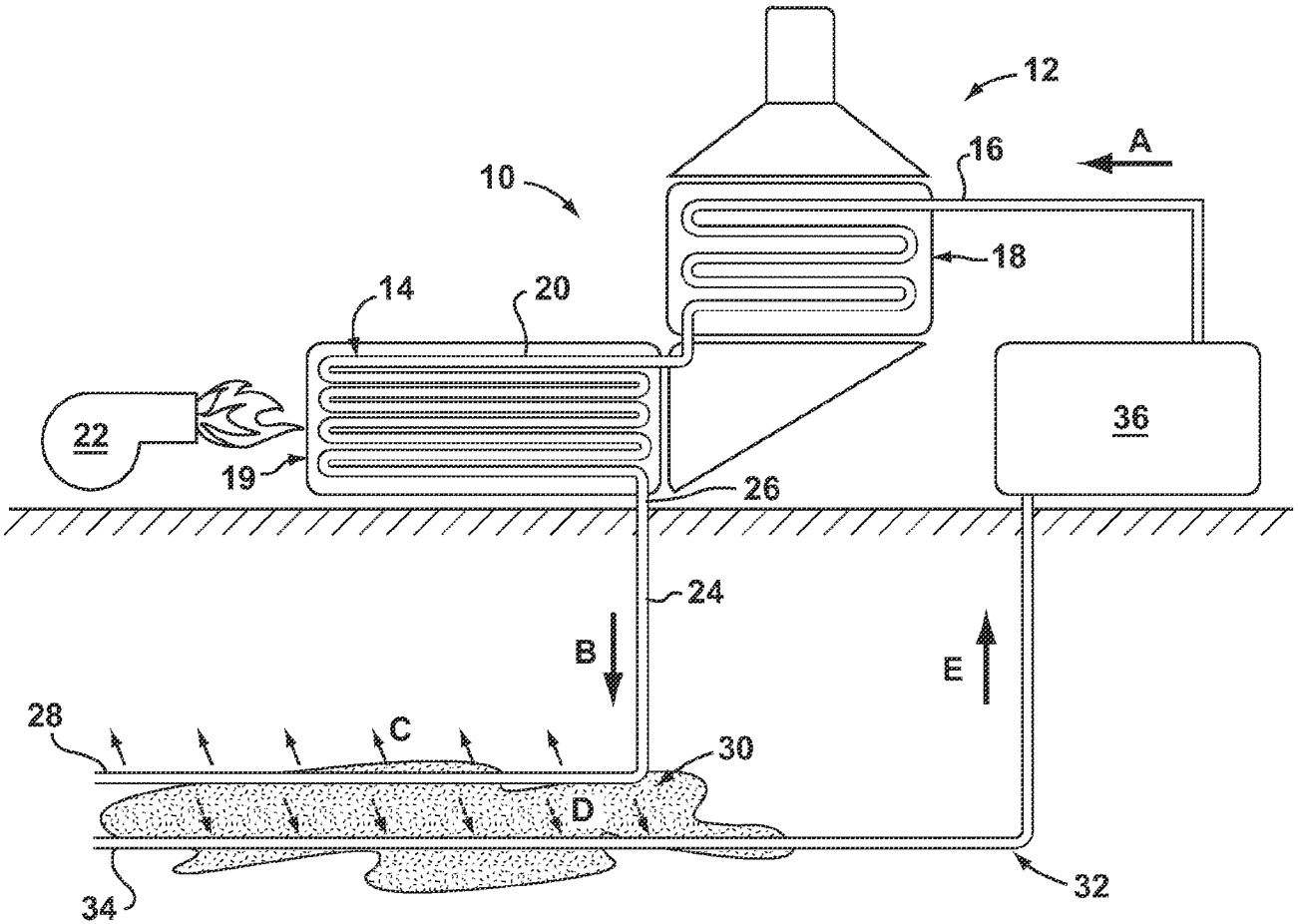
FIG. 1 (PRIOR ART)
FIG. 1 (also described previously) is a schematic illustration of a SAGD system of the prior art.
Figure 2B:
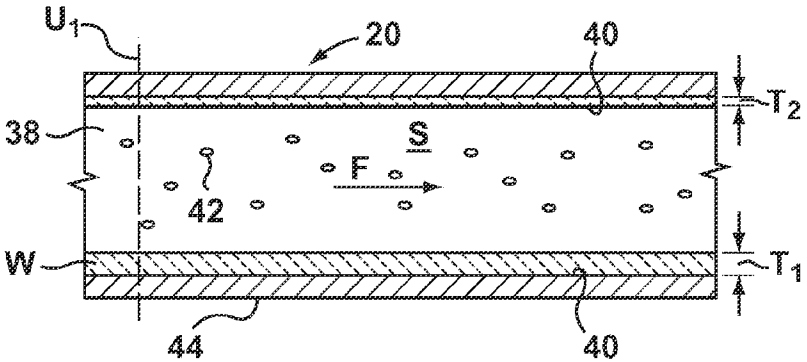
FIG. 2B (Prior Art)
FIG. 2B (also described previously) is a longitudinal cross-section of a portion of a horizontal pipe in a steam-generating circuit of the prior art.
Figure 3B:
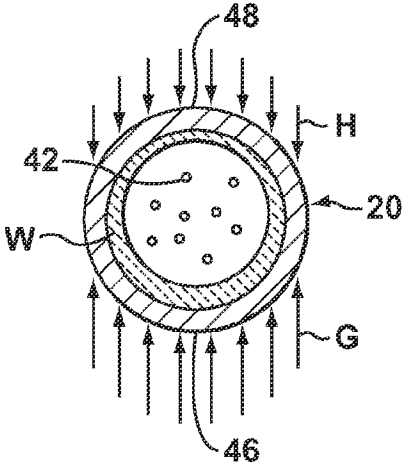
FIG. 3B (Prior Art)
FIG. 3B (also described previously) is a cross-section of a number of pipes in a steam-generating circuit of the prior art, drawn at a larger scale.
Figure 2A:
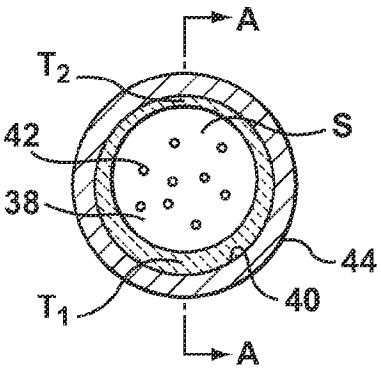
FIG. 2A (Prior Art)
FIG. 2A (also described previously) is a cross-section of a horizontal pipe in a steam-generating circuit of the prior art, drawn at a larger scale.
Figure 3A:
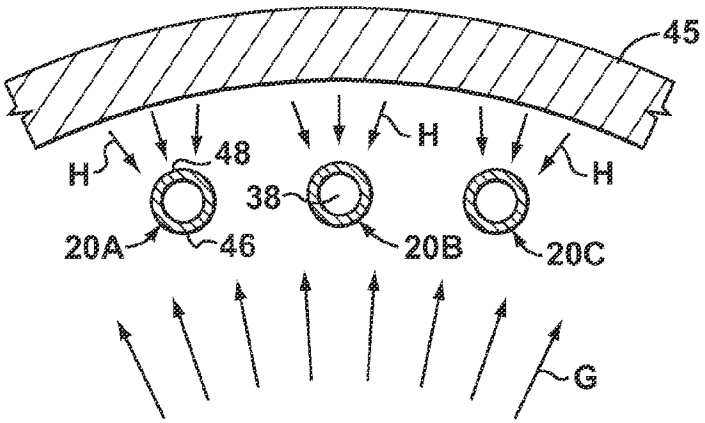
FIG. 3A (Prior Art)
FIG. 3A (also described previously) is a cross-section of a part of the radiant chamber of the prior art, drawn at a smaller scale.

In the attached drawings, the reference numerals designate corresponding elements throughout. Reference is first made to FIGS. 4-7 to describe an embodiment of a system 112 for extracting crude oil from oil-bearing ground 30. The system 112 preferably includes one or more once-through steam generators 110, each having one or more steam-generating circuits 114 extending between inlet and outlet ends 116, 126, and including one or more pipes 120. Preferably, each steam-generating circuit 114 includes a heating segment 147 thereof positioned to at least partially define a heating portion 119 of the once-through steam generator 110 (FIG. 5A). It is also preferred that the OTSG 110 includes one or more heat sources 122 for generating heat to which the heating segment 147 is subjected. Preferably, the steam-generating circuit 114 is adapted to receive feedwater at the inlet end 116, the feedwater being moved toward the outlet and being subjected to the heat from the heat source to convert the feedwater into wet steam (i.e., steam and water). As will be described, the concentrations of the impurities in the water increase as the water approaches the outlet end 126, due to evaporation of at least part of the water. In one embodiment, the pipe 120 includes a bore 138 (FIG. 5B) at least partially defined by an inner surface 140. As can be seen in FIGS. 5B and 5C, at least a portion of the inner surface 140 preferably includes ribs (or rifles) 152 at least partially defining a helical flow passage 154 along the inner surface 140. The helical flow passage 154 guides the water therealong to impart a swirling motion thereto, to control concentrations of the impurities in the water. As will also be described, because droplets of the water generally do not separate from the rest of the water (i.e., unlike water flow through the pipe of the prior art), the increase in concentration of impurities is controlled. The feedwater includes substantial initial concentrations of impurities, as will also be described.

In FIG. 5A, the heating region illustrated is a radiant chamber, but as noted above, the heating region may be only in a convective module. Heat transfer in the radiant chamber 119 is predominantly through radiation.

Also, those skilled in the art will appreciate that the OTSG 110 may include a number of parallel steam-generating circuits. To simplify the discussion, the description herein is focused on only one steam-generating circuit.

The swirl flow profile developed by the rifles creates a centrifugal force that pushes any entrained droplets to the annular film of water. In addition, the swirl rotation develops an annular film with a substantially uniform thickness all around the inner surface 140. As compared to the smooth-walled inner surface 40 of the prior art pipe 20, the thickness of the water film is increased because virtually none of the water is in the form of the entrained droplets. The rifled (ribbed) pipe enables the enhanced oil recovery OTSG to operate at higher steam qualities without dry out.

In one embodiment, the system 112 preferably also includes a water treatment means 156 for producing the feedwater. Preferably, the system 112 also includes a first ground pipe subassembly 158 in fluid communication with the steam-generating circuit 114 via the outlet end 126 thereof. In one embodiment, the first ground pipe subassembly 158 preferably includes a distribution portion 128 for distributing the steam in the oil-bearing ground 30, and a first connection portion 160, for connecting the distribution portion 128 and the steam-generating circuit 114. It is also preferred that the system 112 includes a second ground pipe subassembly 162 with a collection portion 134 for collection of an oil-water mixture. The oil-water mixture is a mixture of the crude oil from the oil-bearing ground and condensed water resulting from condensation of the steam in the ground. Preferably, the collection portion 134 is in fluid communication with the water treatment means 156 via a connection pipe 164, so that the oil-water mixture is supplied to the water treatment means 156 from the second ground pipe subassembly 162. In one embodiment, the water treatment means 156 preferably is adapted to produce the feedwater from the oil-water mixture.

Preferably, the water is subjected to substantially uniform heat generated by the heat source as the water flows along the helical flow passage due to the swirling motion of the water. As will be described, because of the helical path followed by the water along the helical flow passage, the water is subjected to both the greater and the lesser heat flux. It will be understood, however, that the pipe is subjected to unequal heat flux.

It will be appreciated by those skilled in the art that, in one embodiment, the wet steam produced at the outlet and may be sent to a steam separator (not shown in FIG. 4) to remove the water content, and the resulting dry steam is then sent down the well.

In the water treatment means 156, the crude oil and the water preferably are separated. The water is then treated to remove certain impurities, to a limited extent, and (if the water resulting is to be used as feedwater), make up water is added if necessary, before the water is returned to the OTSG 110, i.e., as feedwater.

In one embodiment, the water treatment means 156 preferably is adapted to produce the feedwater from the oil-water mixture, as described above. However, in other embodiments, the water portion of the oil-water mixture, once such water portion and the crude oil have been separated, and the water is treated in the water treatment means 156, may not be recycled back to the OTSG as the feedwater. In both embodiments, however, the feedwater added to the OTSG 110 at the inlet 116 contains relatively high concentrations of impurities typical for enhanced oil recovery OTSGs, as described above.

As noted above, it is contrary to the usual practice in operating steam generators to allow the feedwater to include substantial initial concentrations of impurities. Those skilled in the art will appreciate that operating the system with such feedwater involves dealing with a number of novel issues arising due to the relatively high levels of impurities. Preferably, the steam-generating circuit is operated so as to control the concentrations of impurities, to the greatest extent possible.

It is preferred that the water treatment means 156 is any suitable means for separating the crude oil and the condensed water, to the extent needed. For instance, the feedwater typically has the following initial concentrations:

| | |
|---|---|
| Hardness: | 0.2 ppm or higher |
| Silica | 50 ppm |
| Iron | 0.1 ppm |
| Total dissolved solids (TDS) | 300 to 12000 ppm |
| Total organic carbon | 10 to 300 ppm |
| Oil | 0.5 ppm |
| Alkalinity | 300 to 2000 ppm. |

Accordingly, for the purposes hereof, "substantial initial concentrations of impurities" means:

TDS 10 ppm or higher

Hardness levels of 0.1 ppm or higher.

Figure 4:
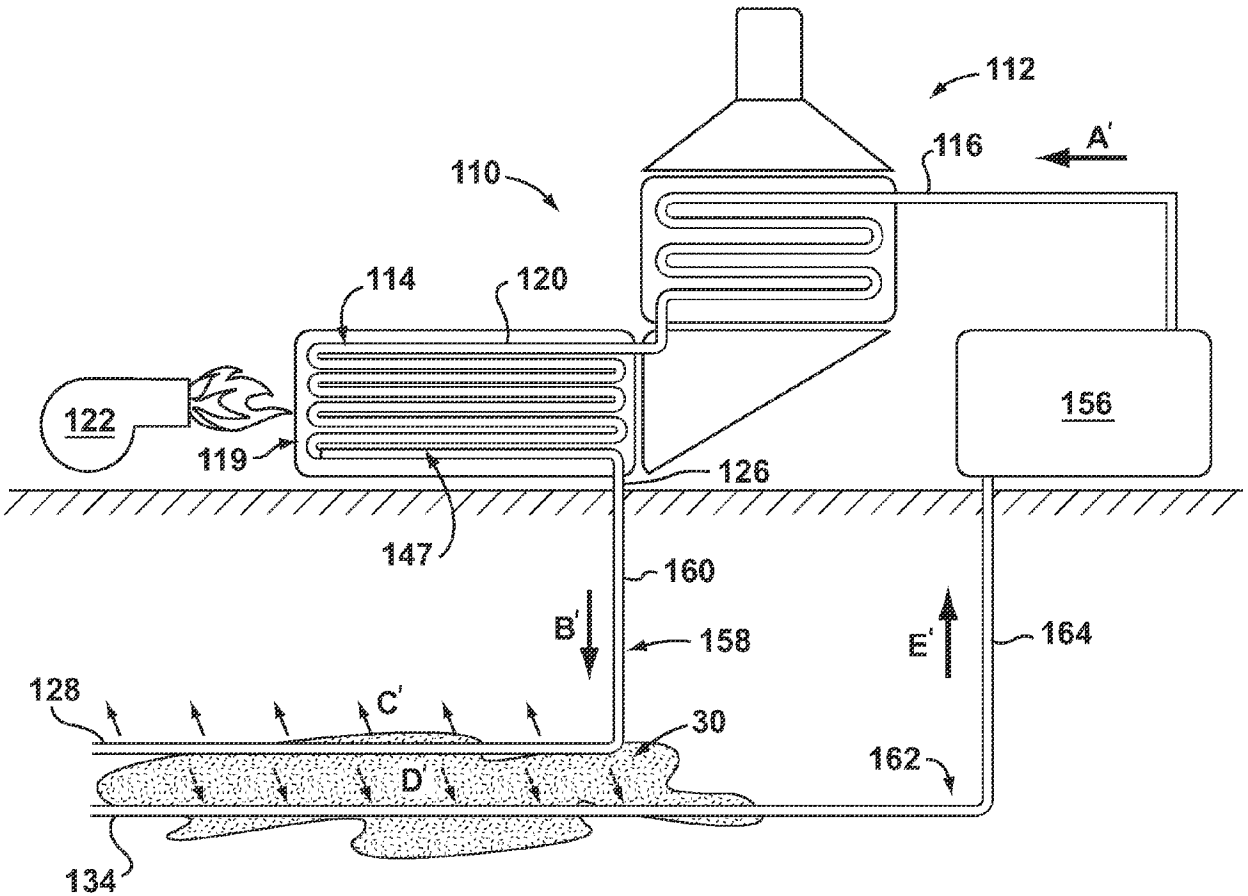
FIG. 4 is a schematic illustration of an embodiment of a system of the invention, drawn at a smaller scale.
Figure 5A:
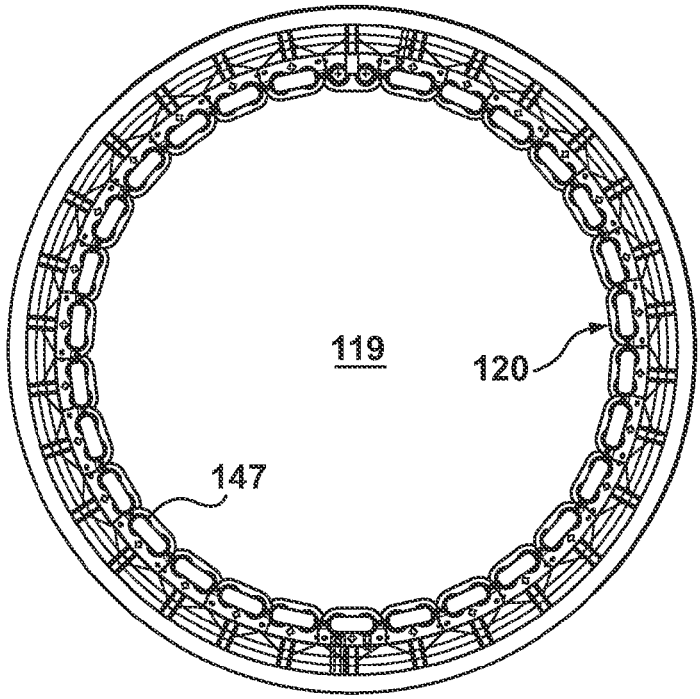
FIG. 5A is an end view of a portion of an embodiment of a once-through steam generator of the invention, drawn at a larger scale.
Figure 5C:
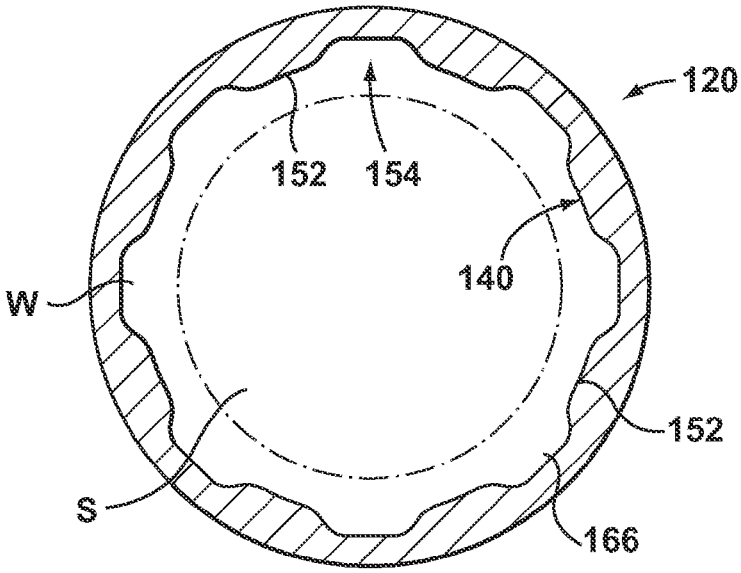
FIG. 5C is a cross-section of the pipe of FIG. 5B, drawn at a smaller scale.
Figure 5B:
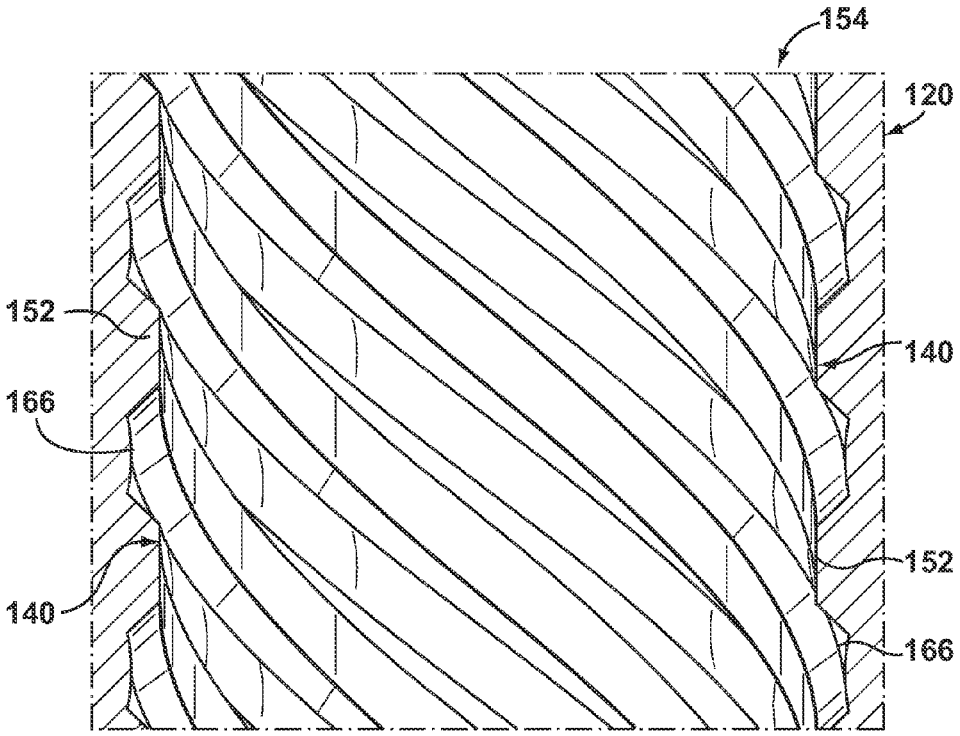
FIG. 5B is a longitudinal section of a portion of an embodiment of a pipe of the invention, drawn at a larger scale.

Referring to FIG. 4, the feedwater is pumped into the steam-generating circuit 114 at the inlet end 116 thereof, as schematically indicated by arrow A'. As indicated by arrow B', steam exiting the steam-generating circuit 114 via the outlet end 126 is directed into the first ground pipe subassembly 158. The steam is released into the oil-bearing ground 30 from the pipe 128 via holds therein, as indicated by arrow C'. The condensed water and the crude oil flow downwardly, under the influence of gravity, to the collection pipe 134 (arrow D'). Finally, the oil-water mixture is directed along the connection pipe 164 to the water treatment means 156 (arrow E').

As can be seen, for instance, in FIGS. 5B and 5C, in one embodiment, the ribs 152 preferably at least partially define a number of channels 166 therebetween. It will be understood that the helical flow passage preferably includes a number of channels 166, but may, for instance, include only one channel 166.

Figure 8:
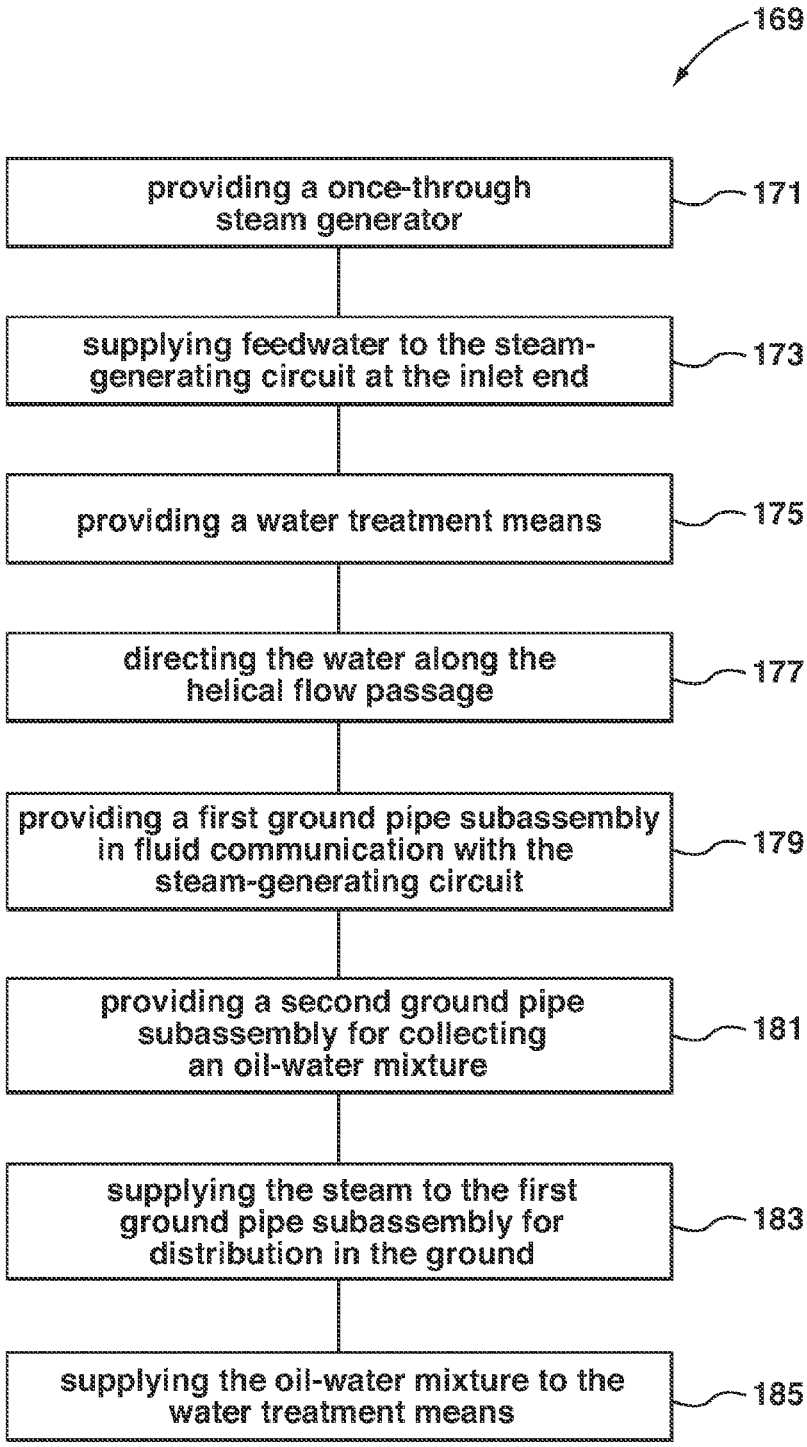
FIG. 8 is a schematic illustration of an embodiment of a method of the invention.

In use, practising one embodiment of a method 169 of the invention involves, first, a step 171 of providing a once-through steam generator 110 (FIG. 8). Next, feedwater is supplied to the steam-generating circuit 114 at the inlet end 116 (step 173). The feedwater is subjected to heat from the heat source 122 as the feedwater passes through the pipe 120, to convert the feedwater into steam and water. The water includes concentrations of impurities which increase as the water/steam mixture approaches the outlet end 126. In one embodiment, the invention additionally includes a step of providing the water treatment means 156 for producing the feedwater (step 175). Water is directed along the helical flow passage 154 to substantially prevent entrainment of droplets of the water in the steam for controlling concentrations of the impurities in the water at the inner surface 140 (step 177). In addition, the helical flow passage 154 develops a substantially uniform film thickness around the full pipe internal perimeter, thereby preventing a thinning of the upper part of the film (in a horizontal pipe) due to gravity effects. A first ground pipe subassembly 158 is provided (step 179). Also, a second ground pipe subassembly 162 is provided (step 181). The steam generated in the steam-generating circuit 114 is supplied to the first ground pipe subassembly 158, through which the steam is distributed in the oil-bearing ground 30 (step 183). The oil-water mixture which results (i.e., as described above) is supplied to the water treatment means 156 for processing thereby for separating the crude oil and the condensed water (step 185). It will be understood that the order in which the steps are performed may be varied.

As described above, in one embodiment, the water resulting from the water treatment means is utilized as feedwater. However, in another embodiment, the water resulting from the water treatment means 156 is not so recycled, and the feedwater is provided from another source.

The helical flow passage 154 preferably extends between the inlet end 116 and the outlet end 126. The helical flow passage 154 may be included in only a selected portion of the pipe 120. For example, in one embodiment, the pipe length closest to the OTSG exit where the steam quality is highest includes rifled inner surface for a predetermined length. As schematically represented by arrow "J" in FIG. 6B, the helical flow passage imparts a swirling motion to the annular water film W. Because of this, entrained droplets generally are not formed, or if they are formed, the entrained droplets are relatively quickly returned to the annular film, in contrast to the prior art. The fluid swirl imparted by the helical flow passage 154 develops a substantially uniform water film thickness at the inner surface 140 of the rifled pipe. Accordingly, the invention results in a generally lower impurity surface concentration, as compared to the prior art. This has the beneficial consequence that localized high impurity concentrations are generally avoided. Due to the relatively high initial concentrations of impurities, it is more important than in the usual situation (i.e., where the feedwater is fully conditioned) that the concentrations of impurities be controlled, so that localized high impurity concentrations are generally avoided. The use of the pipe including the helical flow passage facilitates such control.

Most evaporation occurs on the inner surface 140 since the wall temperature is higher than the saturated water temperature of the steam. Elevated wall temperatures are a result of the external heat source being applied to the pipe surface. Evaporation of the entrained droplets (if any) will occur but at a slower rate since the droplets and steam are in close temperature equilibrium. The wetted wall condition results in more efficient heat transfer (i.e., higher rates of evaporation), and the heat transfer coefficient of the steam flow is considerably higher in wetted wall versus dry conditions, as is well known in the art. This is an indication of the higher evaporation rates of a wetted wall condition in comparison to dry wall conditions.

An analysis is completed, for illustration purposes, clarifying the advantage rifled pipes offer in reducing surface concentrations. When operating in wet steam flow, a portion of the flow exits the OTSG as water. At qualities of 75%, 80% and 90%, the exit water content is 25%, 20% and 10% by weight, respectively. Commercially available software is used to calculate the boiling crisis where dry out will occur in a pipe given a certain set of operating conditions and pipe geometry. Utilizing such software, the following conditions are analyzed:

Bare Pipe (no ribs): 3" NPS schedule 80 steel material

Rifled Pipe: 3" NPS schedule 80 steel material (16 rifles, 1.4 mm high)

Orientation: Vertical pipe

Heat Flux: 60 $kW/m^2$ evenly around pipe perimeter

Fluid Mass Flux: 1500 $kg/m^2$ sec

A vertical pipe orientation is used in the analysis to remove the effects of gravity. A bare pipe (i.e., with a substantially smooth inner surface) operating under the above conditions, according to the analysis results, will reach surface dry out at a critical steam quality of 81.2%. The rifled pipe will reach dry out critical steam quality at 99.6%. Since the bare pipe surface is dry at 81.2% steam quality, the amount of entrained water in the bare pipe is shown to be 100%−81.2%=18.8% at the point of critical quality or dry out. Any location within the pipe having a steam quality below 81.2% can be considered to have some water at the pipe surface. The following table summarizes a comparison of bare and rifled pipe data taken from the above analysis.

TABLE 1

| 1<br>Steam quality (%) | 2<br>Impurity Concentrating Factor | 3<br>Surface Water Content Bare Pipe (% wt) | 4<br>Surface Water Content Rifled Pipe (% wt) | 5<br>Ratio Surface Water Content Rifle to Bare Pipes |
|---|---|---|---|---|
| 75 | 4.0 x | 81.2 − 75 = 6.2 | 99.6 − 75 = 24.6 | 24.6/6.2 = 3.97 |
| 80 | 5.0 x | 81.2 − 80 = 1.2 | 99.6 − 80 = 19.6 | 19.6/1.2 = 16.33 |
| 90 | 10.x | — | 99.6 − 90 = 9.6 | 9.6/1.2 = 8.00 |

Column 2: Impurity concentrating factor between OTSG inlet water and OTSG steam exit. The impurities concentrate in the remaining water of the wet steam and increase as the inlet water travels through the OTSG circuit 114.

Column 3: At 81.2% steam quality, the surface has entered a dry condition. The difference between 81.2% and the exiting OTSG steam quality is the amount of water (as a percent of total flow) on the pipe surface.

Column 4: At 99.6% steam quality, the surface has entered a dry condition. The difference between 99.6% and the exiting OTSG steam quality is the amount of water (as a percent of total flow) on the pipe surface.

Column 5: The ratio provides an indication of the increase in surface water content when comparing bare pipe and rifled pipe OTSG designs.

As can be seen in the above table, there is a significant improvement in terms of water surface content between bare pipe and rifled pipe designs. The typical bare pipe OTSG will operate in the range of 75% to 80% steam quality. At 80% quality there is an increase in the water content by a multiple of 16.33 (Table 1) when rifled pipes are utilized. This increase in pipe inside surface wall water content will appreciably help in lowering the surface water impurity concentration and reduce scaling.

At higher steam qualities such as 90%, the increase in rifled pipe surface water compared to 80% bare pipe is 8.00 times as shown in the table. Although the impurity concentrating factor increased by a factor of 2 between 80% and 90% quality, the surface water content increased by a larger factor of 8.00 between the traditional bare pipe OTSG operating at 80% quality and the rifled pipe OTSG operating at 90% quality. Rifled pipes offer the ability to operate at higher steam quality without significantly increasing the surface impurity concentration level, thus reducing the likelihood of over-saturating the impurity components in which case scale may form.

The uniform film thickness around the internal pipe perimeter resulting from the flow swirl reduces the gravity effects and the thin film on the top surface associated with the prior art described above. As such, the pipe is not prone to boiling crisis (dry out) as the steam quality increases through the pipe 120 and operation well above 80% can be made.

Figure 7:
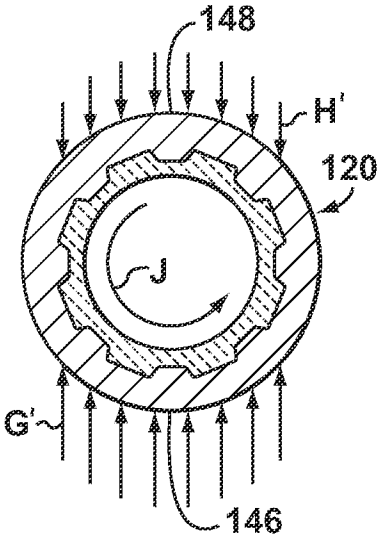
FIG. 7 is a cross-section of the pipe of FIGS. 6A and 6B with heat flux schematically illustrated.
Figure 6B:
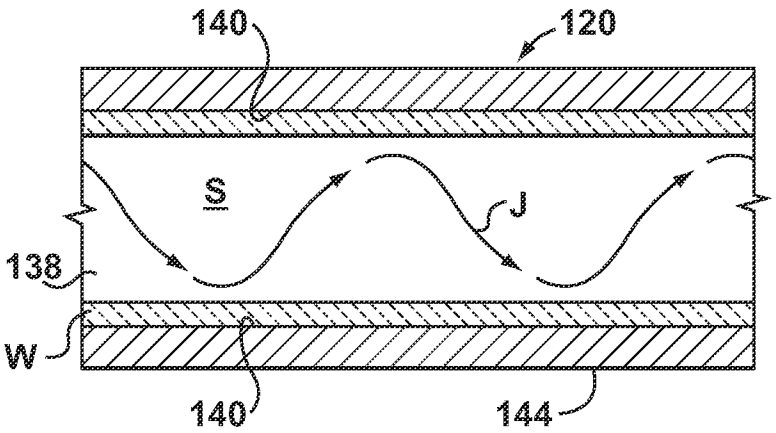
FIG. 6B is a longitudinal section of the pipe of FIG. 6A taken along line Y-Y.
Figure 6A:
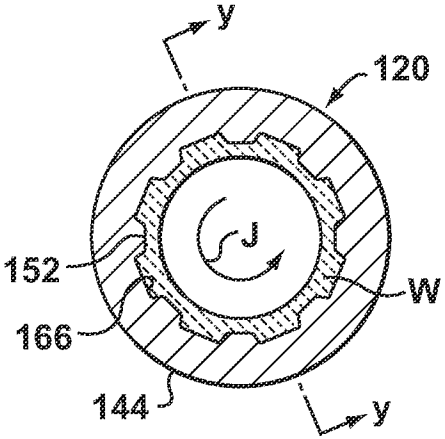
FIG. 6A is a cross-section of the pipe of FIG. 5B with an annular film of water therein, drawn at a smaller scale.

One pipe 120 is shown in FIG. 7. The arrow G' schematically represent heat radiated directly toward the pipe 120 from the heat source 122. An inner side 146 of a pipe perimeter 144 is subjected to the direct heat represented by arrow G' and a outer side 148 is subjected only to indirectly radiated heat, schematically represented by arrows H' (It will be understood that a housing is not included in FIG. 7, for clarity of illustration.) As is known, heat is transmitted from the pipe perimeter 144 to the inner surface 140 by conduction, and also from the inner surface 140 to the annular water film W primarily by conduction. The rate of water evaporation is highest at the high heat flux location (G') of the pipe.

As illustrated in FIG. 7, the high heat flux (G') represented by the arrow G' is directed at the pipe upwardly. However, it will be understood that the heating portion has a generally circular shape, and where the heating portion is horizontal, other pipes in the steam-generating circuit are positioned at other locations to define the circular shape, so that the higher heat flux may be directed towards an upper side or a lateral side of a pipe, or parts therebetween.

In general, the higher heat flux is about three times the lower heat flux (represented by the arrow H' in FIG. 7), when the heating portion is a radiant chamber, i.e., when the heat flux G' results from direct radiation from combustion, and the lower heat flux H' results from indirect radiation, from the backside refractory at least partially defining the radiant chamber. The rate of evaporation on the inner surfaces 140 of the pipe 120 are directly proportional to the external heat fluxes represented by arrows G' and H'. The concentration of impurities increases at a rate three times on the high flux side 146 compared to that on the low flux side 148. (It will be understood that, in practice, the ratio of the higher to the lower heat flux depends on the design of the heating portion.)

It will be appreciated by those skilled in the art that the swirling motion of the annular water film W as it moves along the steam-generating circuit 114 results in relatively consistent concentration of impurities in the water film W. Although the imbalance of heat flux to which the pipe is subjected remains imbalanced (i.e., in that the inner side 146 is subjected to greater heat than the outer side 148) and the resulting rates of evaporation are different between surfaces 146 and 148, the swirling action of the annular water film W results in a substantially even concentration of impurities through the water W around the pipe perimeter. The water flow around the perimeter (i.e., along the helical flow passage) mixes low and high concentrated water resulting from varying rates of evaporation, with the net result of a lower overall average concentration of impurities. The rifled pipe's flow swirl mixes the high and low concentrations of impurities on the surface to obtain an average concentration.

For example, if the higher flux is arbitrarily assigned a value of 1, then (if the heating portion is a radiant chamber) the lower flux would have a value of about 0.33. Because evaporation rates are directly proportional to heat flux, concentrations of impurities in a smooth bore pipe may also be assigned arbitrary values of 1 at the higher flux location 146, and 0.33 at the lower flux location 148. Accordingly, if the rifled pipe is used, the concentrations are averaged, i.e., the following calculation provides the average concentration, using the arbitrary values:

$$\frac{1+0.33}{2}=0.67$$

It can be seen, therefore, that the result of using the rifled pipe is to lower the concentration of impurities at the higher flux location 146 by about 33%. On the lower flux side 148, concentrations are correspondingly increased by about 33%, but the primary concern, as described above, is to mitigate concentrations on the higher flux side 146 of the pipe 120. This effect leads to a reduced probability of localized impurity oversaturation and resulting deposits as the water moves toward the outlet end 126.

Based on thermal dynamic modelling, it appears that the once-through steam generator of the invention can achieve steam quality ratings of approximately 90% or more, representing a significant improvement over the prior art.

It will be appreciated by those skilled in the art that the invention can take many forms, and that such forms are within the scope of the invention as described above. The foregoing descriptions are exemplary, and their scope should not be limited to the embodiments referred to therein.

I claim:

1. A method of extracting crude oil from oil-bearing ground comprising the steps of:

(a) providing a once-through steam generator comprising:

at least one steam-generating circuit extending between inlet and outlet ends thereof and comprising at least one pipe, said at least one steam-generating circuit comprising a heating segment at least partially defining a heating portion of said at least one once-through steam generator;

at least one heat source for generating heat to which the heating segment is subjected;

said at least one pipe comprising a bore therein at least partially defined by an inner surface, at least a portion of the inner surface comprising ribs at least partially defining a helical flow passage along the inner surface;

(b) supplying feedwater comprising substantial initial concentrations of impurities to the steam-generating circuit at the inlet end, the feedwater being moved toward the outlet end and being subjected to heat from said at least one heat source as the feedwater passes through said at least one pipe to convert the feedwater into steam and water, the water comprising the impurities at concentrations thereof that increase as the water approaches the outlet end, wherein steam quality in the steam-generating circuit proximal to the outlet end is at least approximately 90%;

(c) providing a water treatment means for producing the feedwater;

(d) directing the water along the helical flow passage to impart a swirling motion thereto, to provide substantially consistent concentrations of the impurities in the water;

(e) providing a first ground pipe subassembly in fluid communication with the steam-generating circuit via the outlet end thereof, the first ground pipe subassembly comprising:

a distribution portion for distributing the steam in the oil-bearing ground;

a first connection portion, for connecting the distribution portion and the steam-generating circuit;

(f) providing a second ground pipe subassembly comprising:

a collection portion for collection of an oil-water mixture comprising the crude oil from the oil-bearing ground and condensed water resulting from condensation of the steam in the ground;

the collection portion being in fluid communication with the water treatment means;

(g) supplying the steam to the first ground pipe assembly, through which the steam is distributed in the oil-bearing ground;

(h) collecting the oil-water mixture in the collection portion;

(i) supplying the oil-water mixture to the water treatment means;

(j) using the water treatment means, separating the crude oil and the condensed water from each other; and (k) adding make-up water to the condensed water to provide the feedwater having the substantial initial concentrations of the impurities.

2. A method according to claim 1 in which the initial concentrations of the impurities comprise at least 50 ppm of silica and 0.1 ppm of iron.

3. A method of extracting crude oil from oil-bearing ground comprising the steps of:

(a) providing a once-through steam generator comprising:

at least one steam-generating circuit extending between inlet and outlet ends thereof and comprising at least one pipe, said at least one steam-generating circuit comprising a heating segment at least partially defining a heating portion of said at least one once-through steam generator;

at least one heat source for generating heat to which the heating segment is subjected;

said at least one pipe comprising a bore therein at least partially defined by an inner surface, at least a portion of the inner surface comprising ribs at least partially defining a helical flow passage along the inner surface;

(b) supplying feedwater comprising substantial initial concentrations of impurities to the steam-generating circuit at the inlet end, the feedwater being moved toward the outlet end and being subjected to heat from said at least one heat source as the feedwater passes through said at least one pipe to convert the feedwater into steam and water, the water comprising the impurities at concentrations thereof that increase as the water approaches the outlet end, wherein steam quality in the steam-generating circuit proximal to the outlet end is at least approximately 90%;

(c) directing the water along the helical flow passage to impart a swirling motion thereto, to provide substantially consistent concentrations of the impurities in the water;

(d) providing a first ground pipe subassembly in fluid communication with the steam-generating circuit via the outlet end thereof, the first ground pipe subassembly comprising:

a distribution portion for distributing the steam in the oil-bearing ground;

a first connection portion, for connecting the distribution portion and the steam-generating circuit;

(e) providing a second ground pipe subassembly comprising a collection portion for collection of an oil-water mixture comprising the crude oil from the oil-bearing ground and condensed water resulting from condensation of the steam in the ground;

(f) providing a water treatment means in fluid communication with the second ground pipe subassembly, the water treatment means being adapted for separating the crude oil from the water in the oil-water mixture, and for treating the water;

(g) supplying the steam to the first ground pipe subassembly, through which the steam is distributed in the oil-bearing ground;

(h) collecting the oil-water mixture in the collection portion;

(i) supplying the oil-water mixture to the water treatment means; and (j) processing the oil-water mixture at the water treatment means to separate the crude oil and the condensed water; and (k) providing the condensed water to the steam-generating circuit at the inlet end such that the condensed water provided at the inlet end is the feedwater comprising substantial initial concentrations of impurities.

4. A method according to claim 3 in which the initial concentrations of the impurities comprise at least 50 ppm of silica and 0.1 ppm of iron.

5. A method according to claim 3 wherein the steam generating circuit is capable of generating 90% steam with feedwater having up to 12000 ppm of total dissolved solids.

6. A method of extracting crude oil from oil-bearing ground comprising the steps of:

(a) supplying feedwater comprising substantial initial concentrations of impurities to a steam-generating circuit at an inlet end of at least one pipe thereof, the feedwater being moved toward an outlet end of said at least one pipe thereof and being subjected to heat from at least one heat source as the feedwater passes through said at least one pipe to convert the feedwater into steam and water;

(b) directing the water along a helical flow passage to substantially prevent entrainment of droplets of the water in the steam, to provide substantially consistent concentrations of the impurities in the water, the water comprising the impurities at concentrations thereof that increase as the water approached the outlet end, wherein steam quality in the steam-generating circuit proximal to the outlet end is at least approximately 90%;

(c) distributing the steam in the oil-bearing ground for mixture with the crude oil therein;

(d) collecting an oil-water mixture comprising the crude oil and condensed water resulting from condensation of the steam in the ground;

(e) supplying the oil-water mixture to a water treatment means;

(f) processing the oil-water mixture at the water treatment means to separate the crude oil and the condensed water; and (g) providing the condensed water from said step (f) to the steam-generating circuit at the inlet end such that the condensed water provided at the inlet end is the feedwater comprising substantial initial concentrations of impurities.

7. A method according to claim 6 wherein the steam generating circuit is capable of generating 90% steam with feedwater having up to 12000 ppm of total dissolved solids.

* * * * *